US005460657A

United States Patent [19]

Ally

[11] Patent Number: 5,460,657

[45] Date of Patent: Oct. 24, 1995

[54] ROAD SWEEPING METHOD AND APPARATUS

[76] Inventor: Jaleel K. Ally, Suite 6200, Scotia Plaza, 40 King St. W., Toronto, Ontario, Canada, M5H 3Z7

[21] Appl. No.: 133,835

[22] Filed: Oct. 12, 1993

[51] Int. Cl.[6] ..... E01H 1/08

[52] U.S. Cl. ..... 134/20; 15/320; 15/340.3; 15/345

[58] Field of Search ..... 15/320, 321, 322, 15/345, 346; 134/20, 32, 34

[56] References Cited

U.S. PATENT DOCUMENTS

| | | | |
|---|---|---|---|
| 3,678,534 | 7/1972 | Hilbig | 15/345 |
| 3,942,214 | 3/1976 | Maasberg | 15/320 |
| 4,168,562 | 9/1979 | Maasberg | 15/320 |
| 4,219,155 | 8/1980 | Goerss | 115/320 X |
| 4,845,801 | 7/1989 | Milly et al. | 15/321 |

*Primary Examiner*—Chris K. Moore
*Attorney, Agent, or Firm*—Cushman, Darby & Cushman

[57] ABSTRACT

Method and apparatus for the removal of a liquid film disposed upon a road surface, preferably, environmentally unacceptable anti-freeze solutions such as ethylene glycol upon an airport apron. Apparatus comprises a unit for spraying the road surface with a fluid, preferably, water, and collecting the solution disposed upon the surface. The apparatus comprises a housing defining an inner chamber and having a lower edge operably adjacent and in close proximity to the surface and a portion defining an outlet operably in communication with extraction means by which the liquid is extracted from within the inner chamber; and spray means adjacent the housing for spraying the fluid at such a pressure upon the surface as to effect agitation and dispersal of the liquid in particulate form above the surface within the inner chamber for extraction through the outlet. The invention also includes the apparatus when part of a self-contained mobile spray and collection system.

5 Claims, 3 Drawing Sheets

ROAD SWEEPING METHOD AND APPARATUS

FIELD OF THE INVENTION

This invention relates to a method and apparatus for collecting materials such as snow, ice, small debris and the like and surface liquid on a road surface, particularly ethylene glycol anti-freeze solutions from the surface of an airport apron area.

BACKGROUND OF THE INVENTION

Use of environmentally unfriendly anti-freeze solutions, such as ethylene glycol, to de-ice aircraft on airport aprons is under review in the light of proposals that more frequent de-icing processes be implemented following recent tragic airplane crashes believed to be caused by icing on the plane during periods of waiting on the apron. Thus, de-icing materials have attracted the attention of governmental environmental agencies because of the inability of the airlines to recover acceptable amounts of the spilled anti-freeze materials, particularly ethylene glycol, from the airport apron after a plane has been de-iced.

It is recognized that there is a serious problem in finding a method and equipment to recover the wasted anti-freeze off the apron. There are motorized road sweeping and catchbasin vehicles in use on airport aprons to remove materials such as snow, ice, small debris and the like and surface liquid. One known type of such vehicle utilizes a clockwise rotating broom disposed at an angle to the forward direction of the moving vehicle to direct such materials to a vacuum head which sucks the materials into a waste holding compartment. However, it has been found that unsatisfactory and potentially unacceptable amounts of anti-freeze chemical remain on the surface of the apron. The apron remains overly slippery and reduces good traction to aircraft and personnel, and, thus creates a safety hazard. More importantly, with a film of ethylene glycol still on the apron when rain or water hits the apron area, the water miscible glycol and water mixture runs off into the soil and eventually enters the water table. Such runoff is becoming increasingly unacceptable to governmental environmental agencies.

Alternative motorized vehicles for use on airport aprons having merely a straight vacuum head without a rotating broom have been used. Without the broom, the vacuum head has been significantly enlarged. A further alternative mechanical sweeping vehicle is known with a vacuum head trailing the vehicle. Yet a further alternative sweeping and catching motorized vehicle for use on airport aprons is known which has an eight foot sponge rotatable on the surface of the apron to absorb the anti-freeze mixture while another roller squeezes the sponge to release any fluid collected into a holding tank.

Notwithstanding the various attempts at solving the apparently simple problem of picking up solid and semi-solid objects such as slush, ice, snow, small debris and the like and surface liquids, such as water, glycol, and oil, to-date no satisfactory environmentally acceptable method and machine for use therein are known. There thus remains a demand for apparatus and methods for rapidly and effectively removing anti-freeze solutions from road surfaces which do not cause subsequent environmental problems.

SUMMARY OF THE INVENTION

It is an object of the present invention to provide a method of collecting surface liquid from an airport apron to leave behind only environmentally acceptable amounts of environmentally toxic materials.

It is a further object of the present invention to provide apparatus to effect the above method at acceptable sweeping collection rates.

These and other objects which will become apparent hereinafter are attained in accordance with the invention which provides in its broadest aspect apparatus for spraying a road surface with a fluid and collecting a liquid disposed upon said surface, said apparatus comprising a housing defining an inner chamber and having a lower edge operably adjacent and in close proximity to said surface and a portion defining an outlet aperture operably in communication with extraction means by which said liquid is extracted from within said inner chamber; and spray means adjacent said housing for spraying said fluid upon said surface at such pressure as to effect agitation and dispersal of said liquid in particulate form above said surface within said inner chamber for extraction through said outlet aperture.

Preferably, the spray means is disposed or located within the inner chamber and comprises a fluid conduit having a portion defining a longitudinal aperture or slit through which fluid is passed to and out of the slit, or, alternatively, comprises a plurality of nozzles in communication with the fluid conduit.

I have found that when the jet of fluid emanating from the spray means as a high pressure jet hits a road surface at an angle, preferably, between 20°–40° from the horizontal plane, that most efficient disturbance, agitation and dispersal of the liquid on the road surface occurs to produce particulate material, droplets and the like.

A preferred extraction method and means is that associated with a partial vacuum generating unit which sucks the particulate liquid out of the housing and inner chamber through the outlet aperture.

Surprisingly, I have found that water exiting the spray means under high pressure for instance, at greater than 200 P.S.I., preferably greater than 500 P.S.I., more preferably greater than 1,000 P.S.I. and yet more preferably greater than 2,000 P.S.I., is much more efficient than a compressed air jet in removing the slippery film deposit of ethylene glycol anti-freeze. I have found that the high pressure water jet lifts the slippery film deposit of glycol off both even and uneven surfaces of an airport apron and also from the texture breakdown of the surface. Whether the pressurized water upon hitting the ethylene glycol liquid produces an emulsion or other form of mixture having different physical characteristics than undiluted ethylene glycol in droplet form is not known. The action of the water in agitating and dispersing the ethylene glycol provides a more diluted glycol solution within the inner chamber of the housing to make it more readily subject to extraction into the vacuum head and passage up a vacuum hose to a holding tank at practicable and reasonably low pressures.

The apparatus defined hereinabove may be provided as a separate and distinct unit for use in combination with a vehicle for traversing a road surface, such as, an airport apron.

Accordingly, the invention provides in a further aspect a mobile spraying and collection system comprising in combination, a vehicle for traversing a road surface having a liquid thereupon and a spraying unit for spraying said surface with a fluid, said unit comprising a housing defining an inner chamber and having a lower edge operably adjacent and in close proximity to said surface and a portion defining an outlet aperture operably in communication with extraction means by which said liquid is extracted from within said inner chamber; and spray means adjacent said housing for spraying said fluid upon said surface at such pressure as to effect agitation and dispersal of said liquid in particulate form above said surface within said inner chamber for extraction through said outlet aperture.

Alternatively, the distinct unit as hereinabove defined may form part of a mobile spraying and collection system as a built-in unit.

Accordingly, the invention provides in yet a further aspect a mobile spraying and collection system comprising a vehicle for traversing a road surface having a liquid disposed thereupon, said vehicle having a housing defining an inner chamber and having a lower edge operably adjacent and in close proximity to said surface and a portion defining an outlet aperture operably in communication with extraction means by which said liquid is extracted from within said inner chamber; and spray means adjacent said housing for spraying said fluid upon said surface at such pressure as to effect agitation and dispersal of said liquid in particulate form above said surface within said inner chamber for extraction through said outlet aperture.

Each of the above mobile spraying and collection systems may either have its own waste liquid storage means, liquid storage means for storing the liquid for supply to the spray means, and extraction means by which the particulate liquid is extracted from the inner chamber to the waste liquid storage means.

In still yet a further aspect, the invention provides a method of removing a liquid disposed upon a road surface comprising directing a fluid onto said liquid on said road surface from spray means disposed adjacent a housing defining an inner chamber and having a portion defining an outlet aperture, said fluid being under a sufficiently high pressure so as to effect agitation and dispersal of said liquid in particulate form within said chamber; and generating a partial vacuum within said chamber whereby said particulate liquid is extracted form said inner chamber through said outlet aperture.

BRIEF DESCRIPTION OF THE DRAWINGS

In order that the invention may be better understood, preferred embodiments will now be described, by way of example only, with reference to the accompanying drawings wherein.

DETAILED DESCRIPTION OF THE INVENTION

Figure 1:
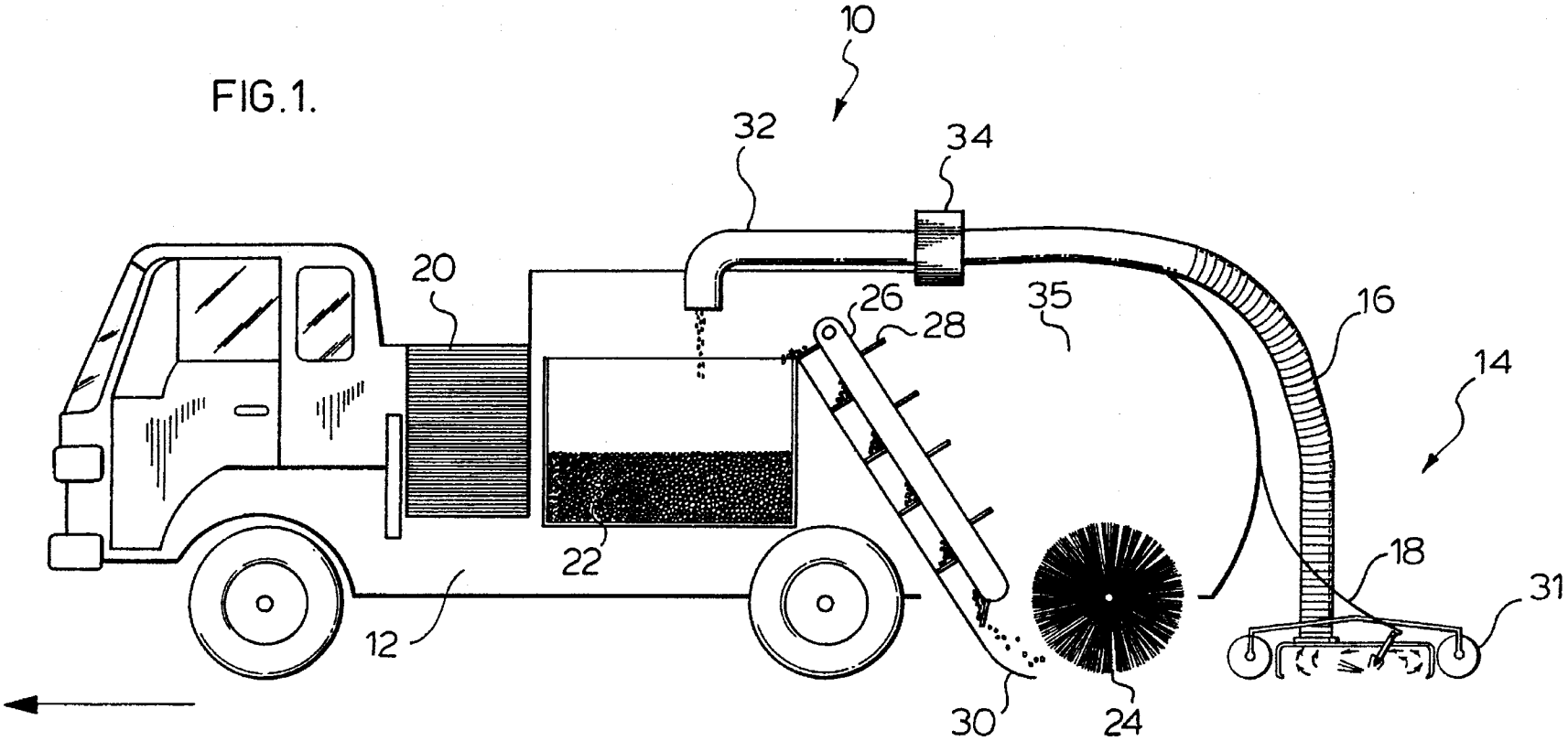
FIG. 1 is a diagrammatic view of a mobile spraying and collection system according to the invention.

A mobile spraying and collection system shown generally as 10 in FIG. 1, comprises in combination a truck 12 and a spraying and collecting unit shown generally as 14 in communication with truck 12 by means of a vacuum hose 16 and high pressure water hose 18.

Truck 12 comprises an engine compartment 20, a waste liquid storage hopper 22, a rear broom 24, a squeegee conveyor 26 having veins 28 and conveyor pan 30.

Closely following broom 24 is spraying and collecting unit 14 supported on swivel wheels 31.

Atop of truck 12 is disposed a vacuum conduit 32, subject to vacuum pump 34 in communication with vacuum hose 16. Truck 12 has a water holding tank 35 for providing water under high pressure through hose 18.

Figure 2:
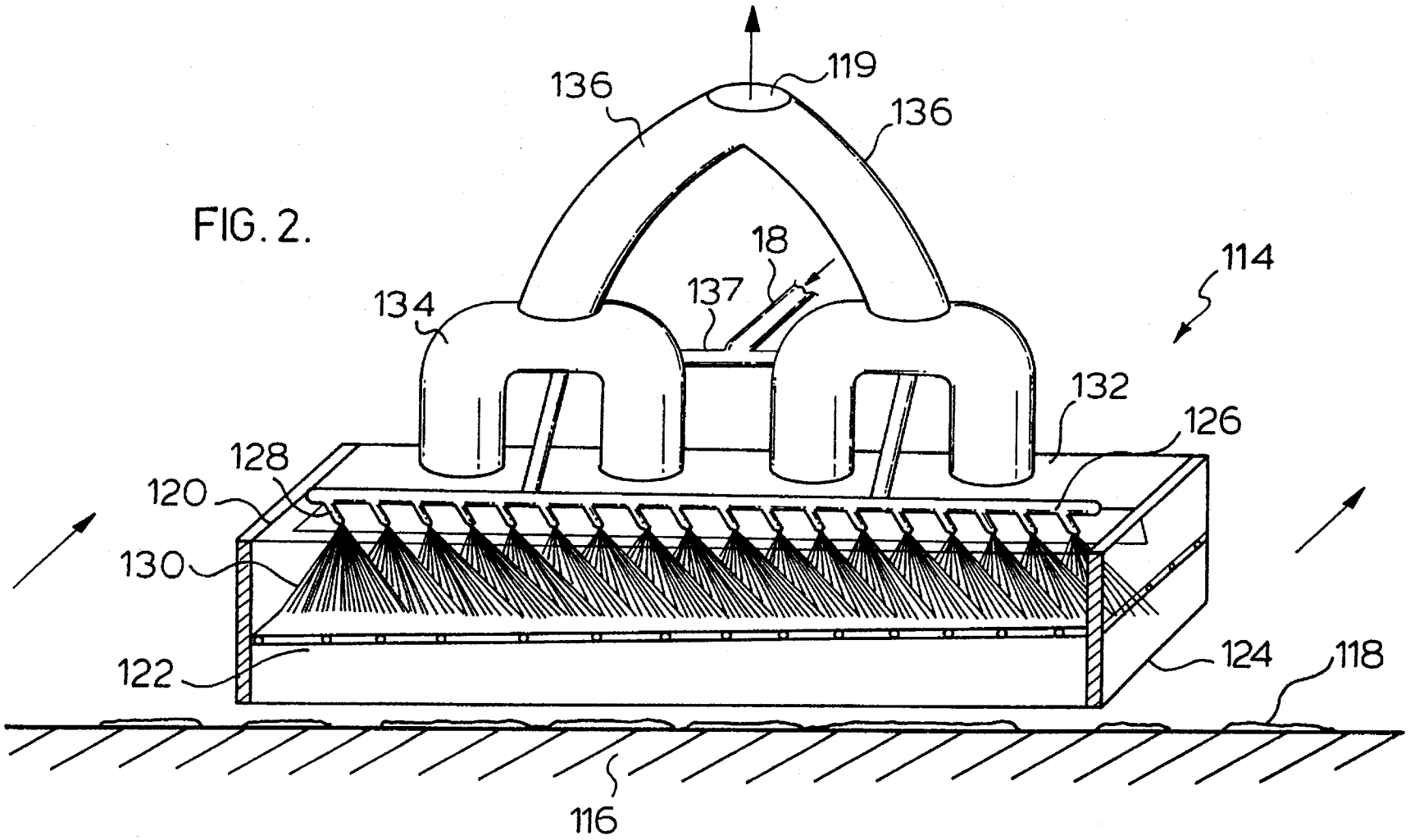
FIG. 2 is a perspective longitudinal view of apparatus according to the invention for spraying and collecting liquid disposed upon a surface.

With particular reference now to FIG. 2 wherein is shown, generally as 114, an apparatus, adapted for use with means for supplying water and means to generate a vacuum, (not shown in FIG. 2) for spraying a road surface 116, having ethylene glycol anti-freeze liquid 118 disposed thereon.

Unit 114 comprises a substantially rectangular housing 120 (2.4 m×0.6 m×0.15 m) defining an inner chamber 122 and having a lower edge 124 adjacent and in close proximity to surface 116.

Disposed within chamber 122 is a conduit 126 having a plurality of spray nozzles 128 arranged linearly and at an angle A, which is 30° from the vertical plane in the embodiment shown, (See FIG. 3), 10 cm from road surface 16 and 12 cm from rear wall 129 of housing 120 as to operably provide a plurality of water jets, represented pictorially as 130. Conduit 126 is fed by high pressure water hose 18 via a water conduit 137.

Housing 120 at an upper part 132 has a plurality of cylindrical exhaust manifolds 134, four in the embodiment shown, in communication through a pair of conduits 136 and outlet aperture 119 with vacuum hose 16.

Figure 3:
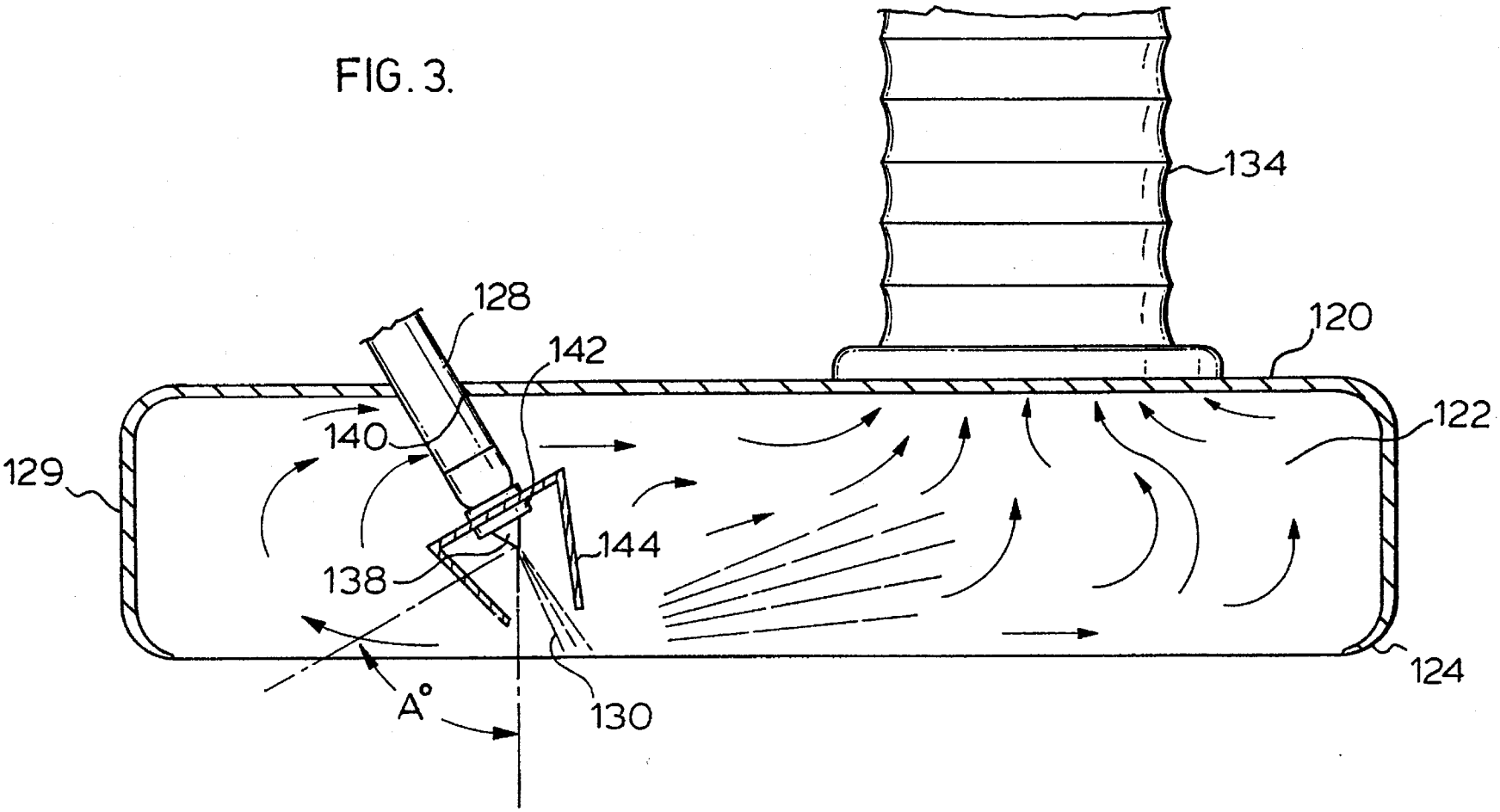
FIG. 3 is a diagrammatic sectional view of an embodiment of apparatus according to the invention.

As is better seen in FIG. 3, each of nozzles 128 terminates in a frusto-conical member 138 defining a circular aperture and retained on tubular body member 140 by hexagonal nut 142. Spray nozzles 128 are provided with deflector plates 144 to better control water spraying on to road surface 116 and prevent water exiting the spray nozzle from being pulled towards the vacuum suction before impinging on road surface 116.

In operation, vehicle 12 traverses road surface 116 having ethylene glycol anti-freeze liquid 118 and, typically, ice, snow, and slush disposed thereupon. The majority of the solid and liquid materials is swept onto conveyor pan 30 by rotating broom 24 and transported by squeegee conveyor 26 to storage hopper 22. However, broom 24 is not able to pick up all of the ethylene glycol anti-freeze liquid 118 remaining as a film on the surface 116. Water from container 35 is forced under pressure through conduits 18, 137,126 and spray nozzles 128 under high pressure, for example, 1000 P.S.I. to provide water jets 130 which act upon liquid 118 on surface 116 to effect agitation and dispersal of liquid 118 in particulate form above surface 116 within inner chamber 122.

The arrows within housing 120 shown in FIG. 3 represent the direction the liquid droplets take under the influence of the vacuum created in housing 120 by means of conduit 32, pump 34 and vacuum hose 16.

Particulate liquid within inner chamber 122 is extracted through hoses 134,136 and, via outlet aperture 119 and hose 16 and deposited in waste liquid storage hopper 22.

It will be understood that housing 120 is adjusted to be so adjacent and in close proximity to surface 116 as to provide a sufficient suction effect within inner chamber 122 from vacuum pump 34.

In an alternative embodiment the water conduit may have a lower portion defining a slot or slit through which water operably exits downwardly, preferably at an angle of 30° from the vertical axis, onto surface 116 and film of anti-freeze 118.

Thus, the apparatus as hereinbefore described comprises means for spraying fluid, e.g. water, upon surface 116, adjacent housing 120, at such pressure as to effect agitation and dispersal of liquid 118 in particulate form above surface 116 within housing 120.

In alternative embodiments, a mobile spraying and collection system according to the invention may have the rotating broom, conveyor pan squeegee conveyor and spraying and collection unit disposed in alternative arrangements, one with respect to another. For instance, the broom and conveyor pan may be in front of the truck. Further, the waste liquid storage hopper 22 may be part of an adjacent vehicle moving in parallel with the mobile spraying and collection system 10.

I have found that vehicle 12 traversing surface 116 at an acceptable speed, for example, 5 miles per hour, while generating a sufficiently high pressure water blast of 2,000 P.S.I. lifted the film of ethylene glycol antifreeze off surface 116 for its removal by the extraction means. In alternative embodiments, the angle of the nozzles in the vertical plane may be adjusted, for instance, by use of ball and socket adjusting members (not shown).

I have found that by having the water jets, preferably, within chamber 122, playing upon the apron surface minimizes the volume of water required to lift the anti-freeze film off of the surface while being readily extracted from the inner chamber. It is highly desirable that only the minimal amount of water be used in order to contain disposal costs of the resultant ethylene glycol/water mixture, and also to reduce the risk of water freezing on the system and apron during the harsh winter months. I have found, typically, that a vacuum extraction means providing for the extraction of 150 $m^3$ per minute of air through a 2.4 m wide×0.6 m long×15 cm high housing disposed less than 10 cm from the surface provides satisfactory particulate liquid extraction.

Surprisingly, I have found that locating the water jet spray means within the housing to cause the water jets to impinge on the road surface behind the housing vacuum outlet aperture in relation to the forward direction of travel of the housing across the road surface, provides better removal of anti-freeze then when the water jets impinge ahead of the housing vacuum outlet. The most satisfactory water jet action is generated when the water jets impinge behind the housing vacuum outlet aperture and at an angle approximately 30° from the vertical axis.

With reference to FIG. 3 the disposition of nozzles 128, within housing 120 provides an unexpected, vastly superior result of glycol removal than does prior art arrangements under comparable water pressure, vacuum and vehicle speed parameters.

Although a water jet pressure of approximately 250 P.S.I. removes more ethylene glycol from a road surface than merely traversing a vacuum at the same rate of speed across the surface, higher water jet pressures are preferred. Pressures of 500 P.S.I. were, surprisingly, not much more effective than the 250 P.S.I. pressure. However, extremely valuable and significant results were obtained using pressures greater than 1,000 P.S.I., particularly at 2,000 P.S.I. Such valuable glycol removal provides the unexpected result of allowing the vehicle to traverse the road surface at much higher speeds and provide the additional benefit of not only faster glycol removal but also, surprisingly, the need for only a minimal and acceptable amount of water usage.

The preferred embodiment described with reference to the drawings when operated at a water jet pressure of 2000 P.S.I. removed substantially all of the oil from an oil coated surface, although an extremely fine oily film remained. The procedure was repeated using a 20% w/w surfactant/water oil dispersant solution. Much improved results of oil film removal were obtained.

Thus, the method and apparatus according to the invention provides means for rapidly, efficiently and with minimal water use, removing anti-freeze solutions from road surfaces.

Although this disclosure has described and illustrated certain preferred embodiments of the invention, it is to be understood that the invention is not restricted to those particular embodiments. Rather, the invention includes all embodiments which are functional or mechanical equivalents of the specific embodiment and features that have been described, and illustrated and claimed.

I claim:

1. A method for removing a liquid disposed upon a road surface comprising:

directing a fluid onto said liquid on said road surface by spray means disposed within an inner chamber of a housing, said housing having an open bottom and a portion defining an outlet aperture, said fluid being directed at such an angle and under sufficiently high pressure so as to effect agitation and dispersal of said liquid in particulate form within said inner chamber; and generating a partial vacuum within said inner chamber whereby said particulate liquid is extracted from said inner chamber through said outlet aperture.

2. A method as claimed in claim 1 wherein said fluid is water.

3. A method as claimed in claim 1 wherein said liquid is an anti-freeze solution.

4. A method is claimed in claim 1 wherein said fluid is directed onto said surface at a pressure greater than 1000 p.s.i.

5. A method of removing anti-freeze solution disposed on a road surface comprising the steps of:

providing an apparatus including a housing defining an inner chamber having an open bottom, a lower edge operably adjacent and in close proximity to the road surface and a portion defining an outlet aperture; extraction means in communication with said outlet aperture for extracting liquid from within said inner chamber; and spray means within said inner chamber, said spray means including a plurality of linearly arranged nozzles;

directing the fluid onto said solution on the road surface from the nozzles at such an angle and under a sufficiently high pressure so as to effect agitation and dispersal of said solution in particulate form above the road surface within said inner chamber; and generating a partial vacuum within said chamber whereby said particulate solution is extracted from said inner chamber through said outlet aperture.

* * * * *